US005984383A

United States Patent [19]

Parikh et al.

[11] Patent Number: 5,984,383

[45] Date of Patent: Nov. 16, 1999

[54] LOCKABLE SLAMMABLE CAM LATCH WITH HANDLE KEY HOLE COVER

[75] Inventors: Bhupendra Parikh, Parma; Donald J. McFarland, Strongsville, both of Ohio

[73] Assignee: Cleveland Hardware and Forging Company, Cleveland, Ohio

[21] Appl. No.: 08/954,676

[22] Filed: Oct. 17, 1997

[51] Int. Cl.[6] ..... E05C 19/10

[52] U.S. Cl. ..... 292/121; 70/208; 292/DIG. 31; 292/126; 292/216

[58] Field of Search ..... 292/96–100, 122, 292/124, 126, 240, DIG. 31, DIG. 30, 121, 216, 197, 224; 70/208, 210

[56] References Cited

U.S. PATENT DOCUMENTS

| | | | |
|---|---|---|---|
| D. 271,562 | 11/1983 | Weinerman | 70/208 |
| 1,459,812 | 6/1923 | Zeman | 292/224 |
| 3,884,056 | 5/1975 | East et al. | 292/98 |
| 4,138,869 | 2/1979 | Pelcin | 70/210 |
| 4,703,961 | 11/1987 | Weinerman et al. . | |
| 4,706,478 | 11/1987 | Swan et al. | 70/208 |
| 4,911,487 | 3/1990 | Rachocki . | |
| 5,015,019 | 5/1991 | Razdolsky | 292/DIG. 31 |
| 5,042,853 | 8/1991 | Gleason et al. | 292/DIG. 31 |
| 5,127,686 | 7/1992 | Gleason et al. . | |
| 5,409,272 | 4/1995 | McCormack | 292/DIG. 31 |
| 5,526,660 | 6/1996 | Bennett et al. | 70/208 |
| 5,551,793 | 9/1996 | Lewis | 292/197 |
| 5,611,224 | 3/1997 | Weinerman et al. | 70/208 |
| 5,820,174 | 10/1998 | Parikh et al. | 292/DIG. 31 |

FOREIGN PATENT DOCUMENTS

| | | | |
|---|---|---|---|
| 2165300 | 4/1986 | United Kingdom | 292/98 |

*Primary Examiner*—Darnell M. Boucher
*Attorney, Agent, or Firm*—Calfee, Malter & Griswold LLP

[57] ABSTRACT

A lockable, slammable rotationally actuated latch assembly for use as a latching and locking mechanism on a door or panel of an enclosure or compartment has a mounting pan with a recessed draw and peripheral mounting flange. A rotatable cam shank intersects the mounting pan and has a handle attached to an end of the cam shank on the exterior side of the pan. A latch is rotationally mounted on a latch shank located on the interior side of the mounting pan and is biased into the latched position by a torsion spring. A cam is attached to an end of the cam shank on the interior side of the pan and the cam has a contact edge positioned to contact and rotate the latch upon rotation of the cam shank. An optional latch guide can also be mounted on a latch shank for guiding a striker into a striker receiving cavity formed between the latch and latch guide. A lock assembly may be mounted on the flange of the mounting pan or inside the recessed draw of the pan. The handle may also have a lock cover with a sealing gasket mounted on the interior portion of the handle so that when the handle is folded relative to the mounting pan the lock assembly is covered.

11 Claims, 8 Drawing Sheets

LOCKABLE SLAMMABLE CAM LATCH WITH HANDLE KEY HOLE COVER

FIELD OF THE INVENTION

The present invention pertains generally to latches and more particularly to rotary locking latches mountable within a closure to a compartment.

BACKGROUND OF THE INVENTION

Rotary operated latches which have a latching arm attached to a rotatable shaft or cam shank are widely used to latch closures such as doors and cabinet or box covers. The cam shank of the latch intersects a pan, with a handle such as a "T" handle attached to one end of the cam shank on the exterior of the pan, and a latch attached to the opposite end on the interior of the pan. Brackets are commonly welded to the interior side of the pan to support both the cam shank and a locking slide which the cam shank also intersects. The locking arm of a lock cylinder actuates the slide relative to the cam shank to control rotation of the cam shank and the latch, by holding a flattened segment of the cam shank in a narrow channel in the slide. With this type of lock mechanism, the latch cannot be moved until the locking slide is retracted by the locking arm. Thus the latch cannot be closed when in the locked condition.

Another disadvantage associated with all types of exterior mounted locking latches is the corrosive effects of exposure to weather elements. The lock cylinder is particularly vulnerable through the exposed key hole.

SUMMARY OF THE INVENTION

The present invention overcomes these and other disadvantages of the prior art by providing in one aspect a rotationally actuated latch comprising a mounting pan having an exterior side and an interior side, a rotatable cam shank intersecting the mounting pan with a handle attached to an end of the cam shank on the exterior side of the pan, a latch rotationally mounted on a latch shank on the interior side of the mounting pan, a cam attached to an end of the cam shank on the interior side of the pan, and the cam having a contact edge positioned to contact and rotate the latch upon rotation of the cam shank.

The invention provides in another aspect a rotary actuated latch assembly comprising a mounting pan having an interior side and a recessed draw, a cam shank and a latch shank each rotationally mounted through the draw, a latch rotationally mounted on the latch shank on the interior side of the mounting pan, a lock assembly mounted in the recessed draw of the mounting pan, a handle pivotally and rotationally mounted upon an end of the cam shank on the exterior side of the pan, the handle having an interior side with a lock cover affixed thereto whereby when the handle is folded down into the recessed draw of the pan the lock cover covers the lock, and a cam attached to an end of the cam shank on the interior side of the pan positionable to contact the latch.

The invention provides in yet another aspect a rotationally actuated latch comprising a mounting pan having an exterior side, an interior side a recessed draw and a peripheral mounting flange; a rotatable cam shank intersecting the mounting pan; a handle attached to an end of the cam shank on the exterior side of the pan; a latch rotationally mounted on a latch shank on the interior side of the mounting pan; a lock slide slidably mounted between the bushing and the interior side of the mounting pan; a lock cylinder mounted in the peripheral mounting flange; the lock cylinder comprising a lock arm positioned for engagement with the lock slide; a bushing fixably mounted upon the cam shank against the interior side of the pan; a cam attached to an end of the cam shank on the interior side of the pan and over the bushing; and the cam having a contact edge positioned to contact and rotate the latch.

The invention provides in still another aspect a cam for use with a latch assembly having a latch rotationally mounted on a latch shank and a cam shank proximate to the latch shank and adapted to support and rotate the cam, the cam comprising: a major flat surface generally perpendicular to the cam shank; an arc shaped edge perpendicular to the major flat surface; a contact edge between a rounded corner and the arc shaped edge positioned for engaging and rotating a latch about the latch shank; and the rounded corner joining the contact edge and a straight edge.

The invention provides in yet another aspect a handle for use with a latch assembly comprising: a mounting pan having an interior side and an exterior side; a latch assembly mounted in the interior side of the pan; a lock assembly mounted in the pan; the lock assembly having a lock face located on the interior side of the pan; a handle pivotally mounted through the pan and positioned to actuate the latch assembly whereby the handle can be folded relative to the mounting pan; and the handle having a lock cover positioned for covering the lock face.

These and other aspects of the invention are herein described in particularized detail with reference to the accompanying Figures.

DETAILED DESCRIPTION OF THE FIGURES

DETAILED DESCRIPTION OF PREFERRED AND ALTERNATE EMBODIMENTS

Figure 3:
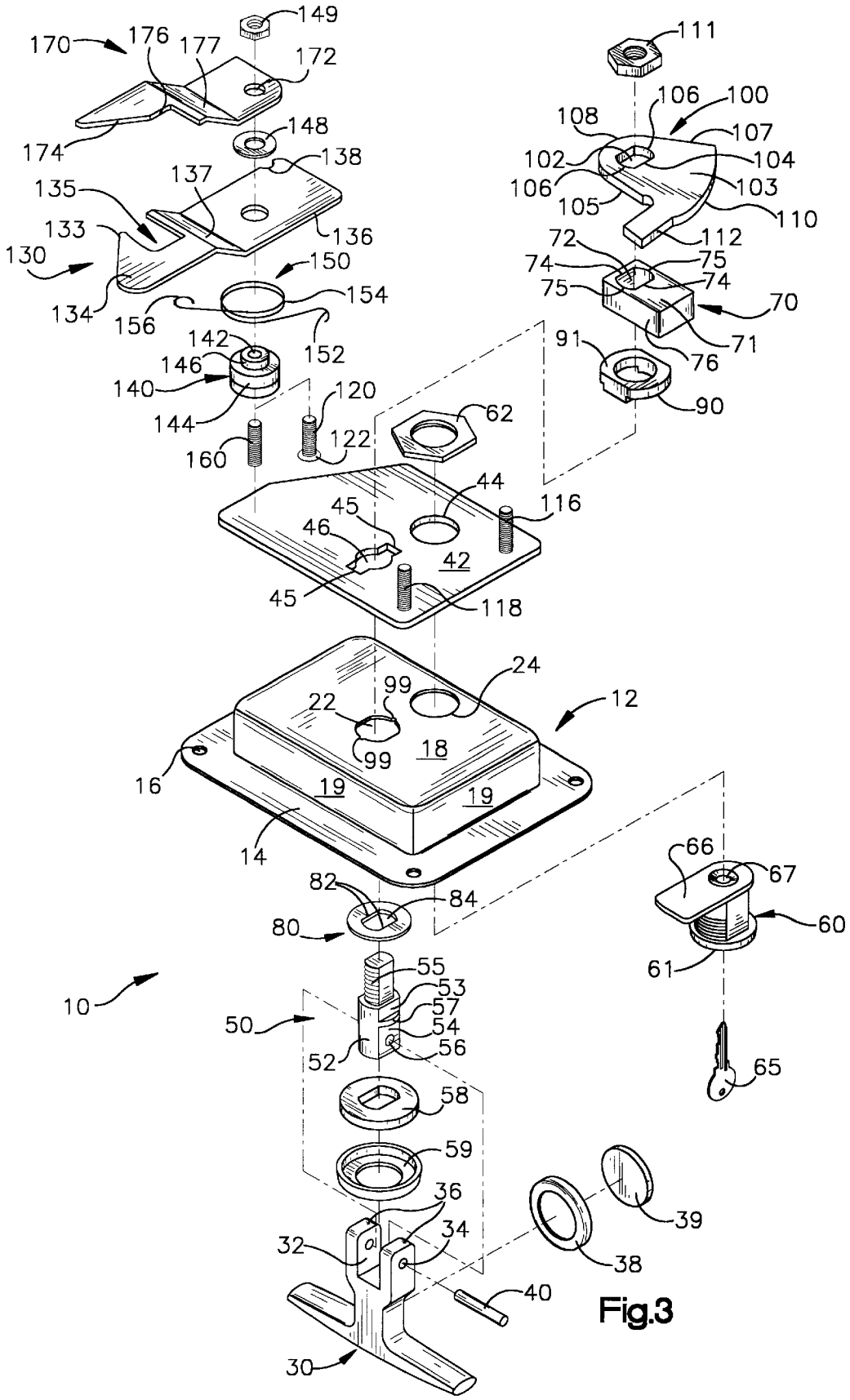
FIG. 3 is an exploded view of the latch assembly of the present invention.
Figure 4:
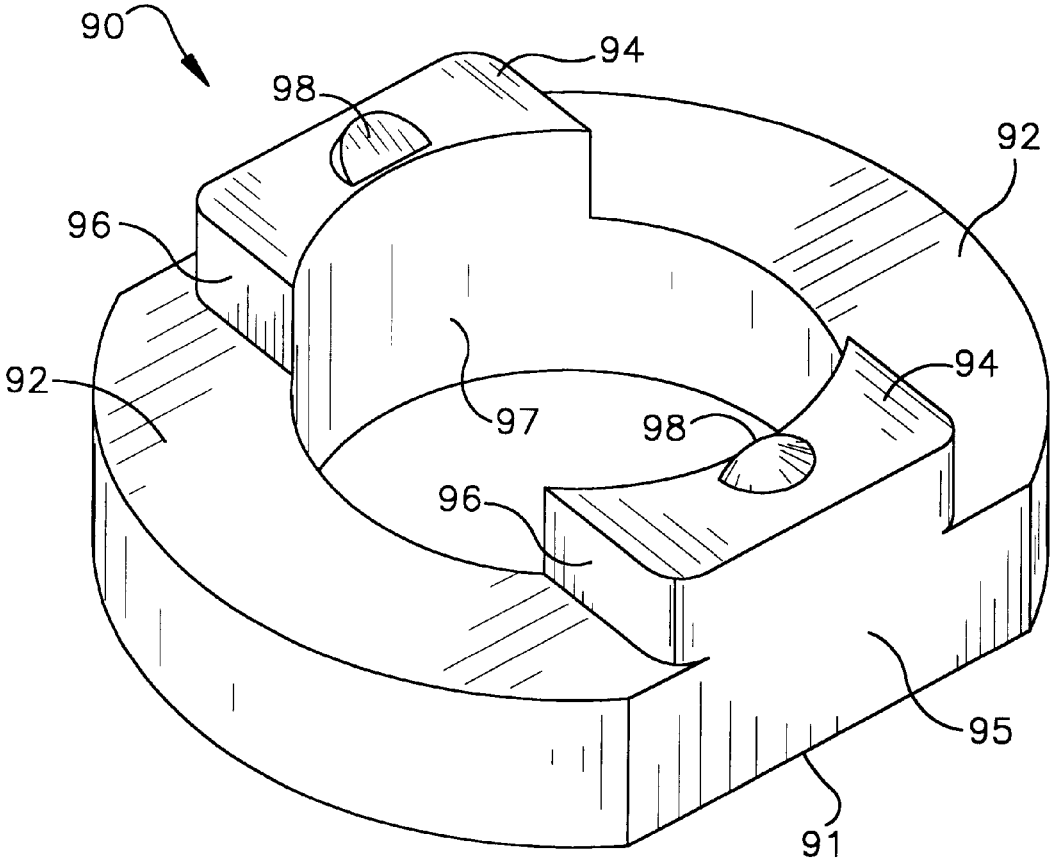
FIG. 4 is a perspective view of a bushing of the present invention.
Figure 5:
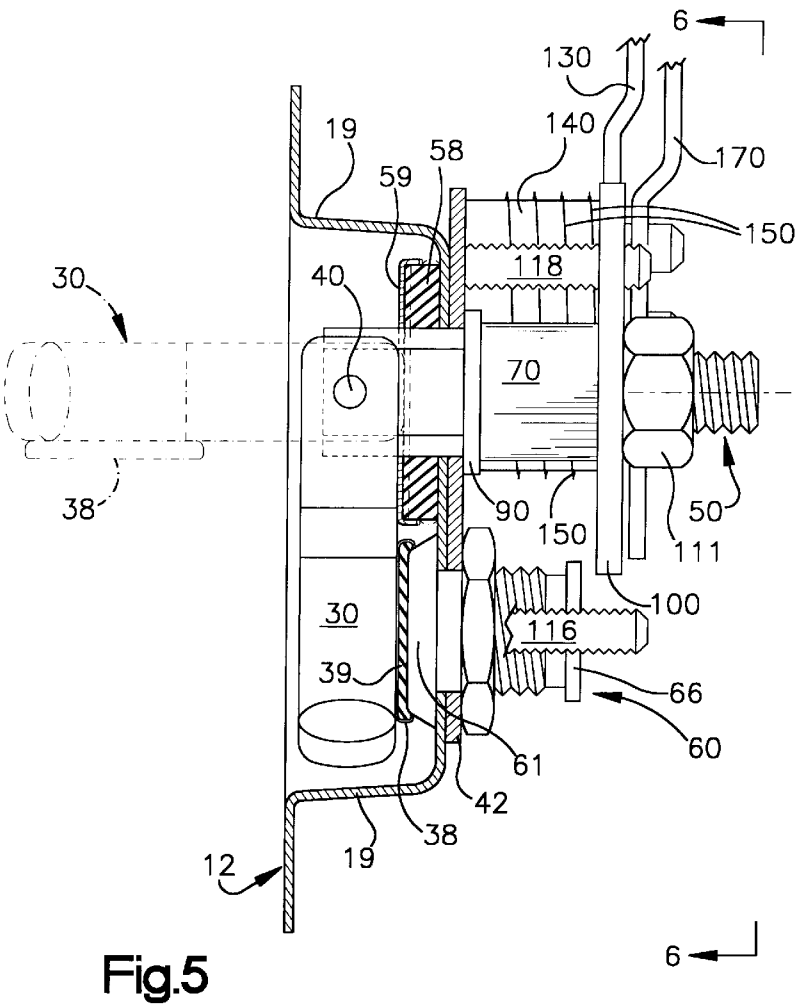
FIG. 5 is a cutaway side view of the latch assembly of the present invention.

With reference to FIGS. 1 through 8, there is shown a rotary actuated T handle cam latch assembly, generally indicated at 10, constructed in accordance with the invention which includes a mounting pan 12 having a peripheral mounting flange 14 adapted to be flush mounted to a door by fasteners through fastener holes 16 and a recessed draw 18 with side walls 19 which protrudes through or sits in a latch opening in a door. A mounting plate 42 is secured to the interior side of the recessed draw 18 of the mounting pan 12 by weld or other attachment means. The mounting plate has a hole 44 for receiving the lock cylinder 60 and a hole 46 for receiving a cam shank 50. A handle 30, such as a "T" handle, is swivel-attached by a wrist pin 40 to an end of the cam shank 50 on an exterior side of the pan such that the handle can be folded relative to the pan 12 as shown. As shown in FIGS. 3 and 5, the interior surface of the handle 30 has a lock cover 38 with a resilient sealing gasket 39 mounted therein such that when the T handle 30 is folded down into the pan 12 the lock cover 38 and gasket 39 shields the exposed face 61 of a lock cylinder 60 from corrosive elements.

A key operated lock cylinder 60 is mounted in a hole 24 in the recessed draw 18 of the mounting pan 12 secured by a lock cylinder nut 62 with a key hole 64 to allow for insertion of a key 65 to operate the lock cylinder. A lock arm 66 is attached to the rotating end 67 of the lock cylinder opposite the key hole 64 and positioned for engagement with the side wall 76 of the lock stop 70.

With reference to FIG. 3 in particular, it is shown that cam shank 50 is mountable through hole 22 in the recessed draw 18 of mounting pan 12 and hole 46 in the mounting plate 42 to intersect perpendicularly the plane of the draw 18. Cam shank 50 includes a generally cylindrical head 52 with inner flats 54 for receiving corresponding flats 32 of handle 30 attached to the cam shank 50 by insertion of handle pin 40 through handle holes 34 and cam shank head holes 56. Flanges 57 extend perpendicularly from flats 32 of the cam shank. A resilient sealing washer 58, covered by a cap washer 59, is placed about the cam shank between flanges 57 and hole 56 to bias the cap washer 59 against rounded ends 36 of handle 30, increasing the friction in the wrist pin of the handle. In this manner, the handle 30 is securely held in either the operative position as shown in phantom in FIG. 5 or the folded position as shown in solid lines. The resilient sealing washer 58 performs the additional function of a moisture barrier by contacting the pan about the periphery of the cam shank receiving hole in the pan.

Bearing surfaces 53 of flanges 57 overlap straight edges 82 of a hole 84 of a cam shank bearing 80 which is placed about the cam shank head 52 on the exterior side of the pan 12 to prevent axial movement of the portion of the cam shank head to which the handle is attached to the pan.

As shown in FIGS. 3 and 4, a bushing 90 is provided about the cam shank 50 on the interior side of the plate 42 on the pan 12 opposite bearing 80. The bushing 90 has a hollow generally cylindrical section 92 with guides 94 extending perpendicular from the plane of cylindrical section 92 in diametric alignment. The mounting plate 42 has a hole 46 having a generally circular shape and rectangularly-shaped opposed guide slots 45 which correspond to the cross-section of the internal walls 97 and the guides 94 of the bushing 90, respectively. Guides 94 are positioned for insertion into guide slots 45 of hole 46 of mounting plate 42. Guides 94 have indexing pins 98 which extend through plate 42 and are positioned for insertion into corresponding index holes 99 of the pan 12 and are provided at the periphery of hole 22 as shown in FIG. 3.

Referring again to FIG. 3, a lock stop 70 is attached to the threaded portion 55 of the cam shank 50. A lock stop mounting hole 72 has opposed parallel edges 74 and rounded edges 75 to correspond to the cross section of and fit over threaded portion 55 of shank 50. The shank 50 includes flats 54 which contact opposed parallel edges 74 of the lock stop mounting hole 72 when the shank is rotated, thereby rotating the lock stop 70 in the direction of the rotation of the shank. The lock stop 70 is mounted on the top face 91 of the bushing 90. An optional sleeve bearing (not shown) may be provided between the lock stop 70 and the bushing 90 to reduce frictional resistance to rotation of the lock stop 70 against the bushing.

As shown in FIG. 3, a cam 100 is attached to the threaded portion 55 of cam shank 50. The cam mounting hole 102 has opposed parallel edges 104 and rounded edges 106 to correspond to the cross section of and fit over threaded portion 55 of cam shank 50. The cam shank flats 54 contact the opposed parallel edges 104 of the cam mounting hole 102 when the cam shank 50 is rotated, thereby rotating the cam 100 in the direction of the rotation of the cam shank. The cam 100 is secured to the latch assembly against opposing top face 71 of the lock stop 70 by a fastener 111 threaded upon the cam shank threaded section 55. Fastener 111 may be self-retaining or attached in connection with a friction washer (not shown) placed against the cam 100.

The cam 100 has a major flat surface 103 and a straight edge 104 and a contact edge 106 joined at approximately sixty degrees by a rounded corner 108, and an arc-shaped edge 110 generally opposite to the rounded corner 108. The contact edge 106 of the cam 100 is positioned for engagement with the lower leg 136 of the latch 130. As the cam shank 50 is rotated by the handle 30, the contact edge 106 of the cam 100 contacts the latch lower leg 136 of the latch 130 causing the latch 130 to rotate about the latch shank from the latched position towards the cam shank 50 into the release position. The edge of the latch lower leg contacts a latch stop 160 when the latch is in the release position preventing further rotation of the latch 130. The rounded corner 108 of the cam acts as a backup stop when the latch 130 is in the release position.

Figure 6:
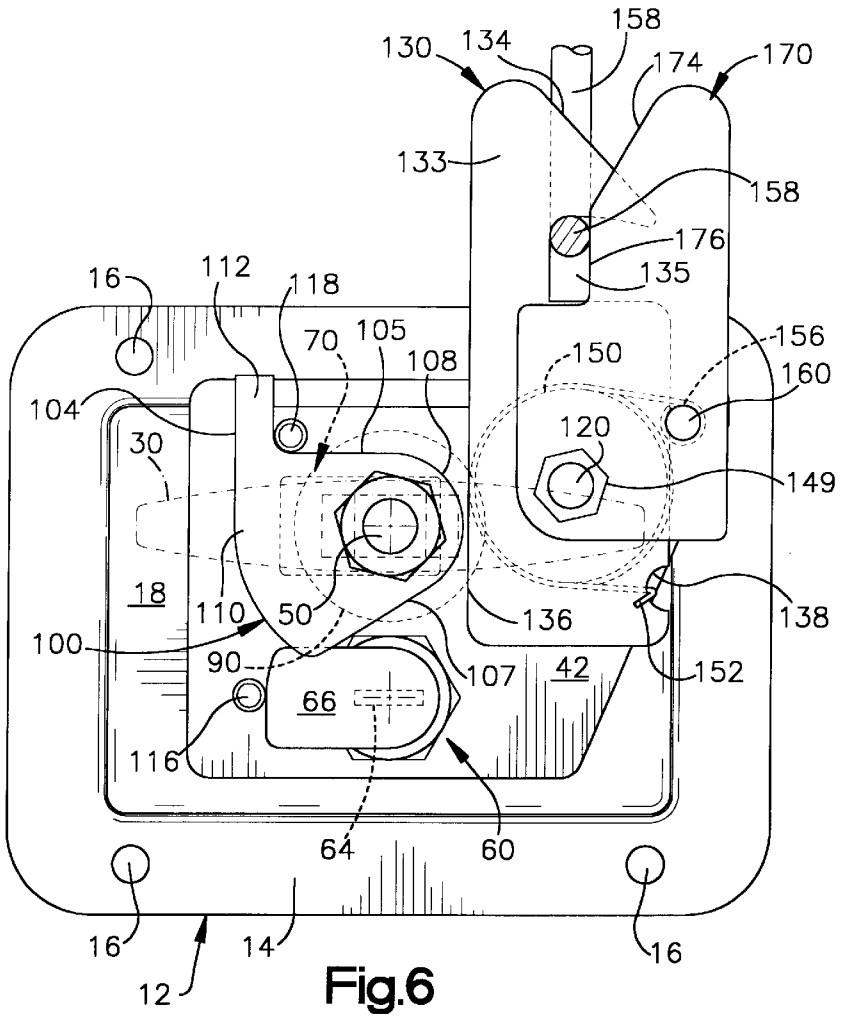
FIG. 6 is a rear view of the latch assembly shown in the unlocked position of the present invention.
Figure 7:
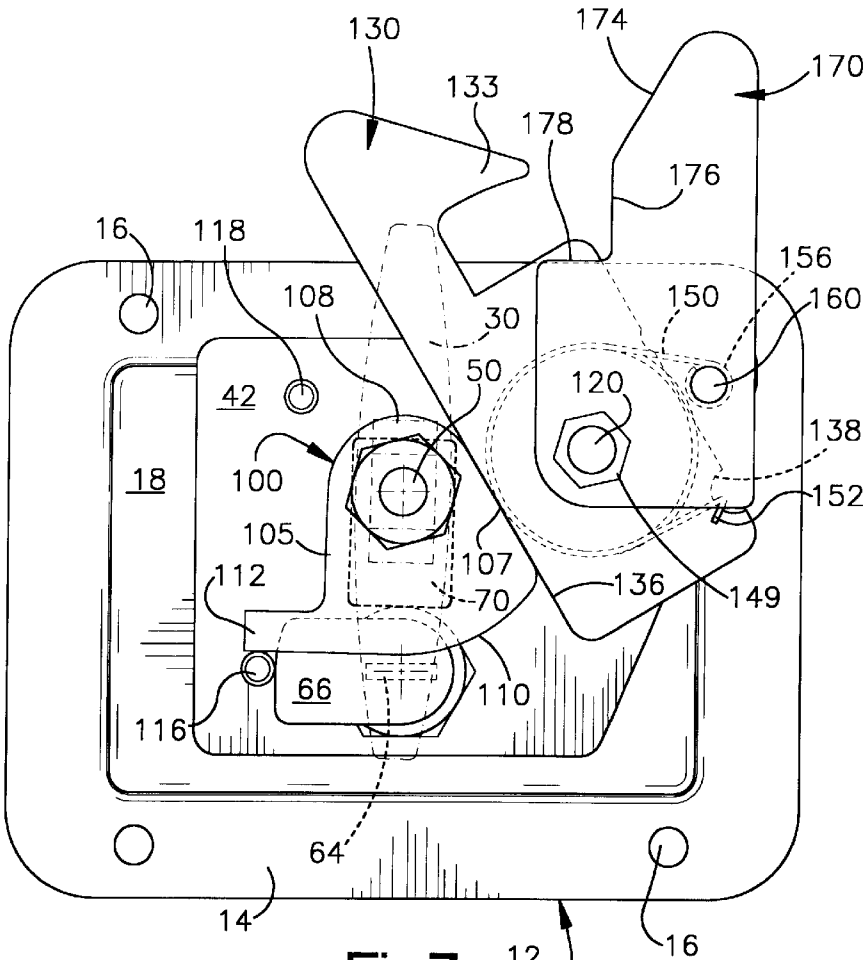
FIG. 7 is a rear view of the latch assembly shown in the release position of the present invention.

Extending orthogonally from the straight edge 104 of the cam 100 and further defined by the arc shaped edge 110 is an arm 112 positioned for contacting a cam stop 116 thereby preventing over-rotation of the cam and thus the latch 130 when the latch is in the release position. The cam as shown in FIG. 6 has a home position (shown in solid lines) which corresponds to the latch in the latched position, and an engagement position as shown in FIG. 7 which corresponds to the latch in the released position. A home stop 118 engages the straight edge 104 of the cam 100 thereby preventing over-rotation of the cam 100 and the cam shank 50 from the home position. Thus the handle 30 will always return to the same home position such that the handle is parallel with the mounting pan side walls 19 allowing the handle 30 to be folded neatly into the pan 12 and over the face 61 of lock cylinder 60.

When the lock arm 66 is in a locked position, i.e., the lock arm 66 blocks the rotation of the lock stop 70 by contacting the sidewall 76, the clearance provided by the rounded corner 108 of the cam 100 allows the latch 130 to be released such to engage a striker 158 when the lock assembly 60 is locked. In addition, when the lock arm 66 is in the locked position the rounded corner 108 also acts as a latch stop to prevent over-rotation of the latch 130.

Referring again to FIG. 3, a latch shank 120 for mounting a latch 130 has a shank head 122 attached to the interior side (such as by weld) of the mounting plate 42 on the mounting pan 12 and a threaded section 122. A shoulder spacer 140 is placed over the shank and a torsion spring 150 is disposed about the shoulder spacer 140. As further shown in FIG. 3, the shoulder spacer 140 includes an inner hole 142 of constant diameter for receiving the latch shank 120, and an outer radial side wall 144 for receiving the torsion spring 150, and a shoulder 146 which fits through a hole 132 in the latch 130.

The latch 130 is pivotally connected and secured to the interior side of the mounting plate 42 by means of the threaded latch shank 120, shoulder spacer 140, spacer washer 148 and lock nut 149. The threaded section of the shank 84 passes through a shoulder spacer hole 142, the latch hole 132, a spacer washer hole 148, and the lock nut 149 such that the latch 130 is rotationally secured to the mounting plate 42 onto the mounting pan 18, to rotate in a plane parallel thereto.

The latch 130 has a hooked end 133 with a slanted incline surface 134 forming a striker receiving cavity 135 for engaging the striker 158. The latch 130 also has a lower leg 136 for contacting the contact edge 106 of the cam 100 upon its rotation, and a latch shoulder 137 formed therebetween the lower leg 136 and the hooked end 133. The latch 130 has a center hole 132 in the lower leg 136 for receiving the shoulder 146 of a shoulder spacer 140 such that the latch 130 is pivotally mounted upon the latch shank 120.

A torsion spring 150 has a first end 152 received in an aperture 138 in the latch lower leg 136, a wound torsion spring body 154 which is wrapped around the outer radial side wall 144 of the shoulder spacer 140, and a second end 156 attached to a latch stop 160. The torsion spring 150 biases the latch 130 into the vertical latched position (shown in solid lines in FIG. 6). The torsional force of spring 150 acting upon the latch 130 chocks the latch lower leg 136 of the latch 130 against the latch stop 160 thereby maintaining the latch 130 into the vertical latched position.

Figure 8:
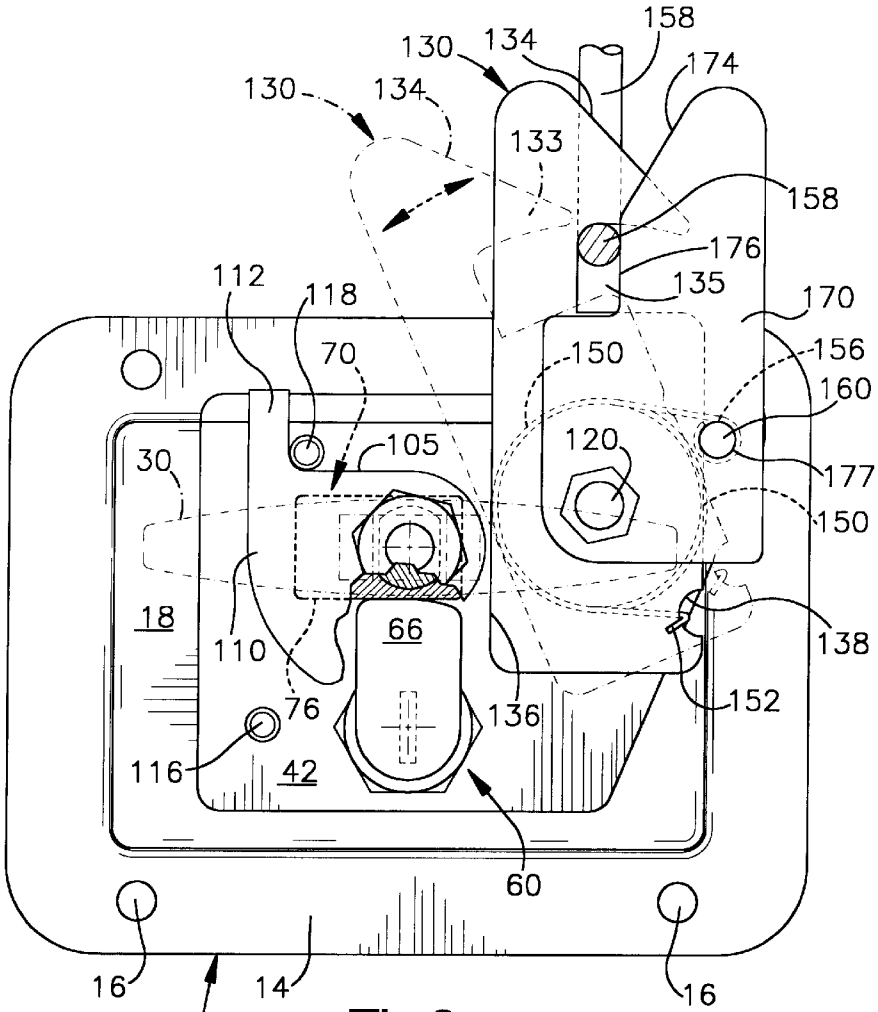
FIG. 8 is a rear view of the latch assembly shown in the locked position of the present invention.

As shown in FIGS. 7 and 8, the torsion spring 150 allows the latch 130 to be deflected for engagement with a striker 158 when the lock arm 66 of the lock cylinder 60 is in either the locked or unlocked position so that the latch can be slammed shut over a striker even when locked. FIG. 7 shows the latch in the released position and FIG. 8 shows the latch 130 in the latched position and the lock arm 66 in the locked position.

Figure 1:
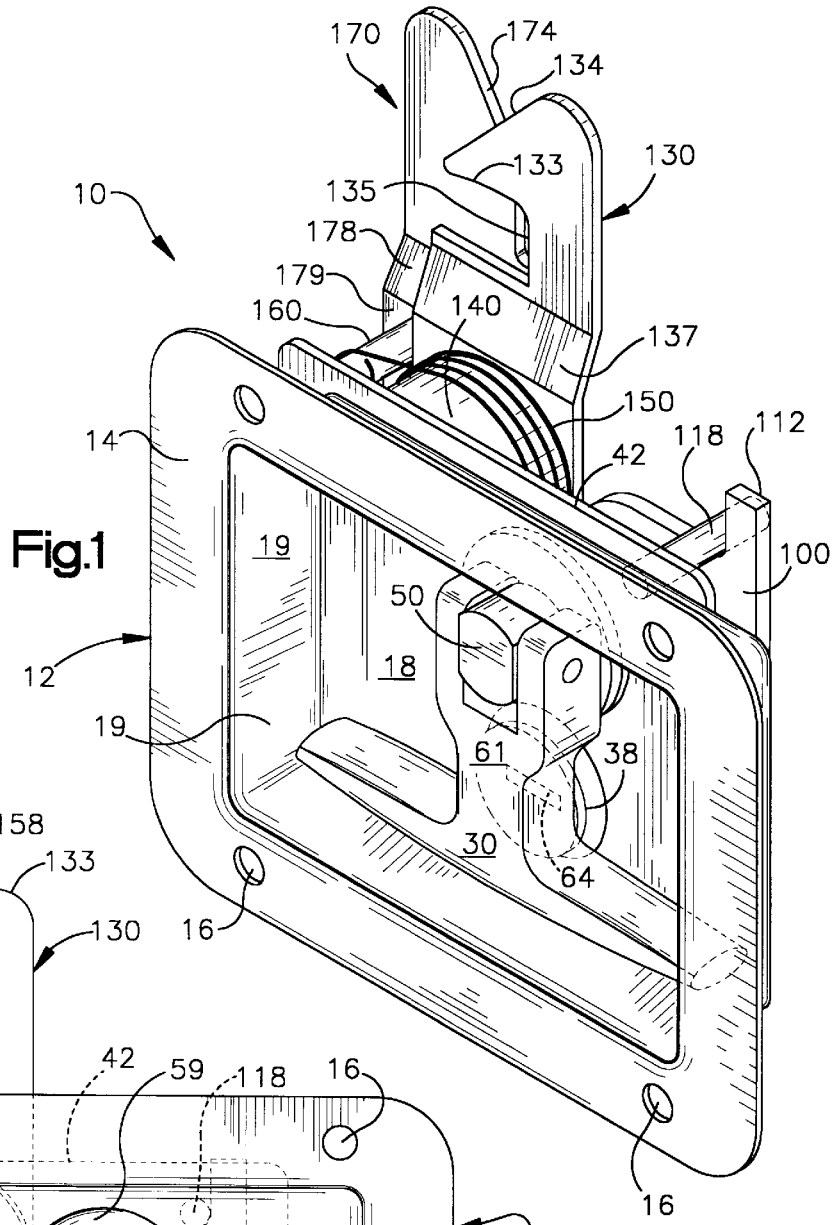
FIG. 1 is a perspective view of the exterior of the latch assembly of the present invention.
Figure 2:
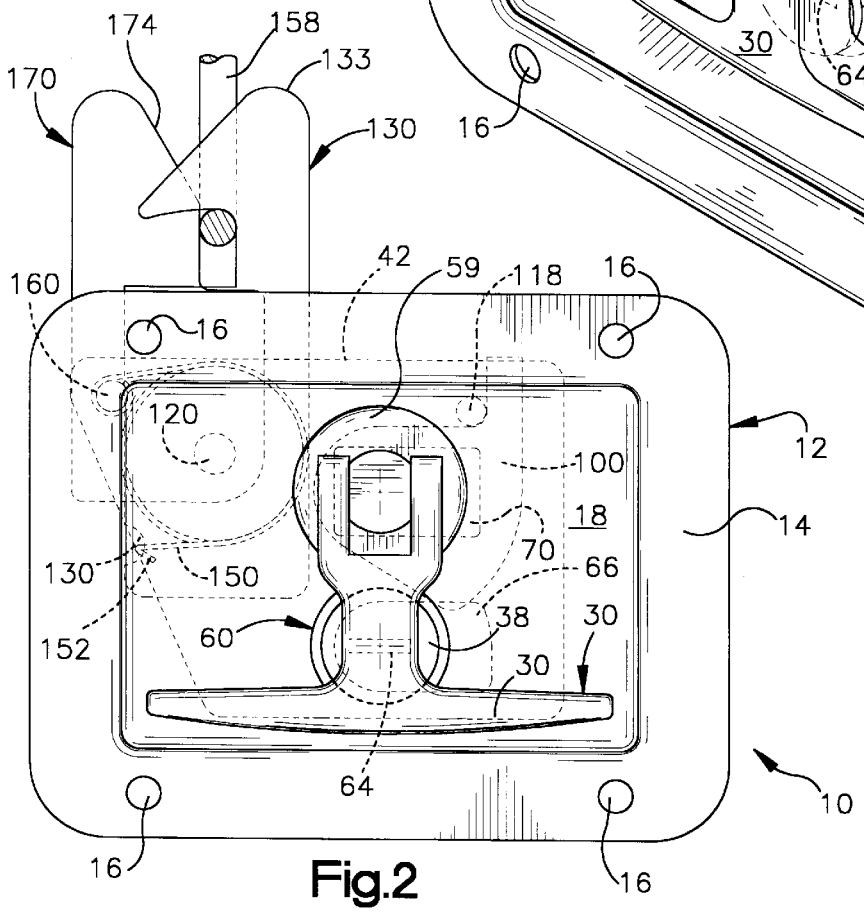
FIG. 2 is a front view of the exterior of the latch assembly of the present invention.

An optional latch guide 170 can also be mounted on the latch shank 120 over the latch 130. The purpose of the latch guide is to more precisely guide a striker, such as a common bar-type striker having a rod section oriented transverse to the hooked end 133 of the latch, into the striker receiving cavity 135. The latch guide 170 comprises a hole 172 for receiving the shank 160, a tapered vertical end 174 for guiding the striker 158 into the striker receiving cavity 135 which is confined by an edge 176 whereby the guide 170 encloses the striker receiving cavity 135 in conjunction with the latch hook end 133 when the latch 130 is in the latched position. The latch guide 170 also acts as a keeper which prevents the striker 158 from moving laterally out from under the hooked end 133 of the latch, or vice versa, as may occur, for example, if an enclosure lid to which the striker is mounted is struck laterally. The latch guide 170 also has a indexing hole 177 which the latch stop 160 is mounted therein to prevent rotation of the latch guide about the latch shank 120. The latch guide 170 also comprises a shoulder 178 formed between the tapered vertical end 174 and the latch guide lower leg 179 to increase the dimensional depth of the latch assembly as shown in FIG. 1.

The operation of the latch assembly is as follows. The handle pin 40 allows pivotal movement of the T handle 30 within the pan draw 18 between a closed/recessed position as shown in bold lines in FIG. 5 and a release/open position as shown in phantom. In operation, as shown in FIG. 6 in a locking embodiment of the latch assembly while the lock arm 66 is in an unlocked position, as the T handle 30 is rotated while in the release/open position, the cam shank 50 correspondingly rotates causing the lock stop 70 and the cam 100 to rotate in unison. As the cam 100 is rotated, the contact edge 106 of the cam 100 contacts the latch lower leg 136, thereby rotating the latch 130 about latch shank 120 towards the lock assembly such that the striker is released from the displaced striker receiving cavity 135 of the latch 130. Thus actuation of the handle 30 results in rotation of the latch 130 from a latched position to a released position to thereby disengage the hooked end 133 of the latch 130 from the striker 158. The door or panel in which the latch assembly is mounted, is thereby unsecured and may be opened.

It is important to note that in disengaging the striker 158 a rotational force is applied by the torsion spring 150 to the aperture 138 of the latch lower leg 136. Thus as the latch 130 is rotated out of engagement with the striker 158, the spring 150 is wound and acts to apply a restoring moment to the latch 130. Once the handle 30 is rotated to its closed/recessed position, the torsion spring 150 force acts upon the latch 130 rotating it towards the latch guide 170 until the lower leg 136 of the latch contacts the latch stop 160 thereby maintaining the latch in the vertical latched position.

The lock arm 66 of the lock cylinder 60 may be rotated by actuation of an external key 65 to a locked position as shown in FIG. 8, wherein the lock arm 66 contacts the side wall 76 of the lock stop 70 thereby blocking its path of rotation. Because the lock stop 70 is prevented from rotating, the cam shank 50 and the cam 100 are also prevented from rotating. When one attempts to actuate the T handle 30 with the lock arm 66 in its locked position, the lock arm prevents movement of the lock stop 70 thereby arresting rotation of the cam shank 50 and the T handle 30. In order to disengage the hooked end of the latch from the striker, it is necessary to rotate the lock arm out of its locked position to thereby allow the T handle 30 to rotate and effectuate rotation of the latch 130.

Because the latch 130 is normally biased towards its latched position, it is possible to close and latch an opened closure/door without using the T handle 30. As the closure/door is moved downward, the striker 158 is forced against the slanted incline 134 of the hooked end 133 of the latch 130. As the striker 158 is moved downward into contact with the slanted incline 134, the latch 130 is forcibly rotated in a clockwise direction and the torsion spring is extended. Once the striker enters the striker receiving cavity, the hooked end 133 of the latch 130 is rapidly rotated in a counterclockwise direction and into engagement with the striker 158 under the restoring force applied by the torsion spring 150. This is a particularly useful feature in that it permits one to lock the closure/door with the lock arm already in the locked position without having to use the key to unlock and then re-lock the lock arm 66. This feature would not be possible if the latch were not independently rotatable.

A second embodiment of the T handle latch will now be discussed. The second embodiment as shown in FIGS. 9 through 13, has the same general features of the first embodiment except for the differences and additions as described, below. In the second embodiment, a lock slide 180 and slide support 200 replace the mounting plate 42, the lock stop 70, a latch stop 160, and the cam stop 116. In addition, the lock assembly 60 is mounted in hole 25 in an expanded portion of the flange 14 of the mounting pan 12 instead of in the recessed draw 18. The lock arm 66 is positioned for engagement with a U shaped portion 182 of a lock slide 180.

Guides 94 of bushing 90 are aligned with straight edges 184 of a cutout 186 in lock slide 180 to guide the lock slide in a fixed linear path upon actuation by the lock arm 66. The protrusion of inner flats 54 of cam shank head 52 through the mounting pan 12 into the bushing 90 and through cutout 186 of lock slide 180 prevents rotation of the shank 50 when inner flats 54 engage against straight edges 184 of cutout 186. Thus, only upon alignment of an axial center of a rounded cutout 188 (having at least a diameter equal to the full diameter of shank head 52) with the axis of the shank head 52 is the shank 50 and thus the cam 100 allowed to rotate.

Figure 11:
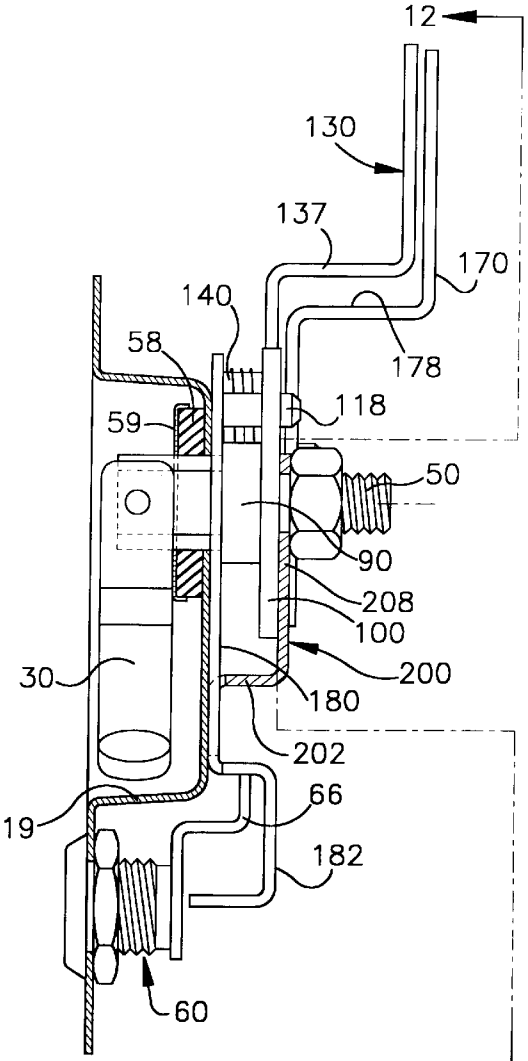
FIG. 11 is a side view of the latch assembly of the present invention as shown in FIG. 9.
Figure 9:
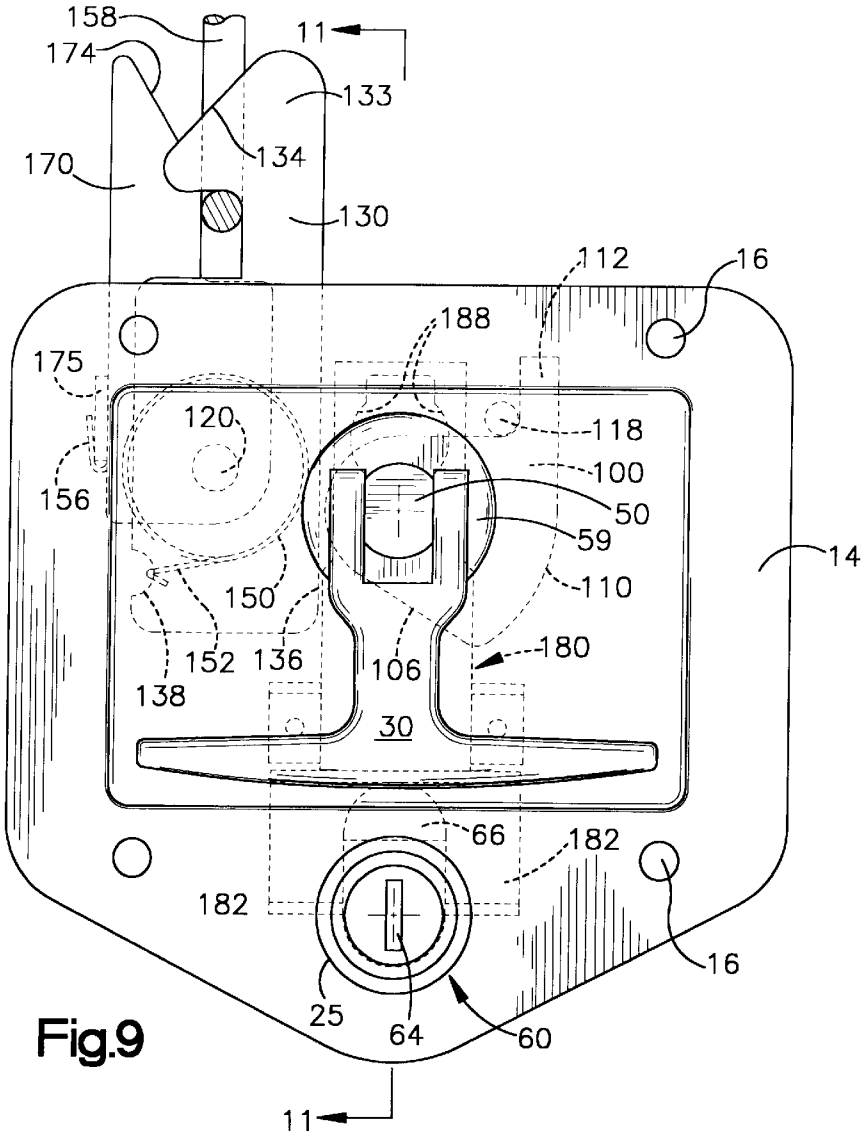
FIG. 9 is a front view of another embodiment of the latch assembly of the present invention.
Figure 10:
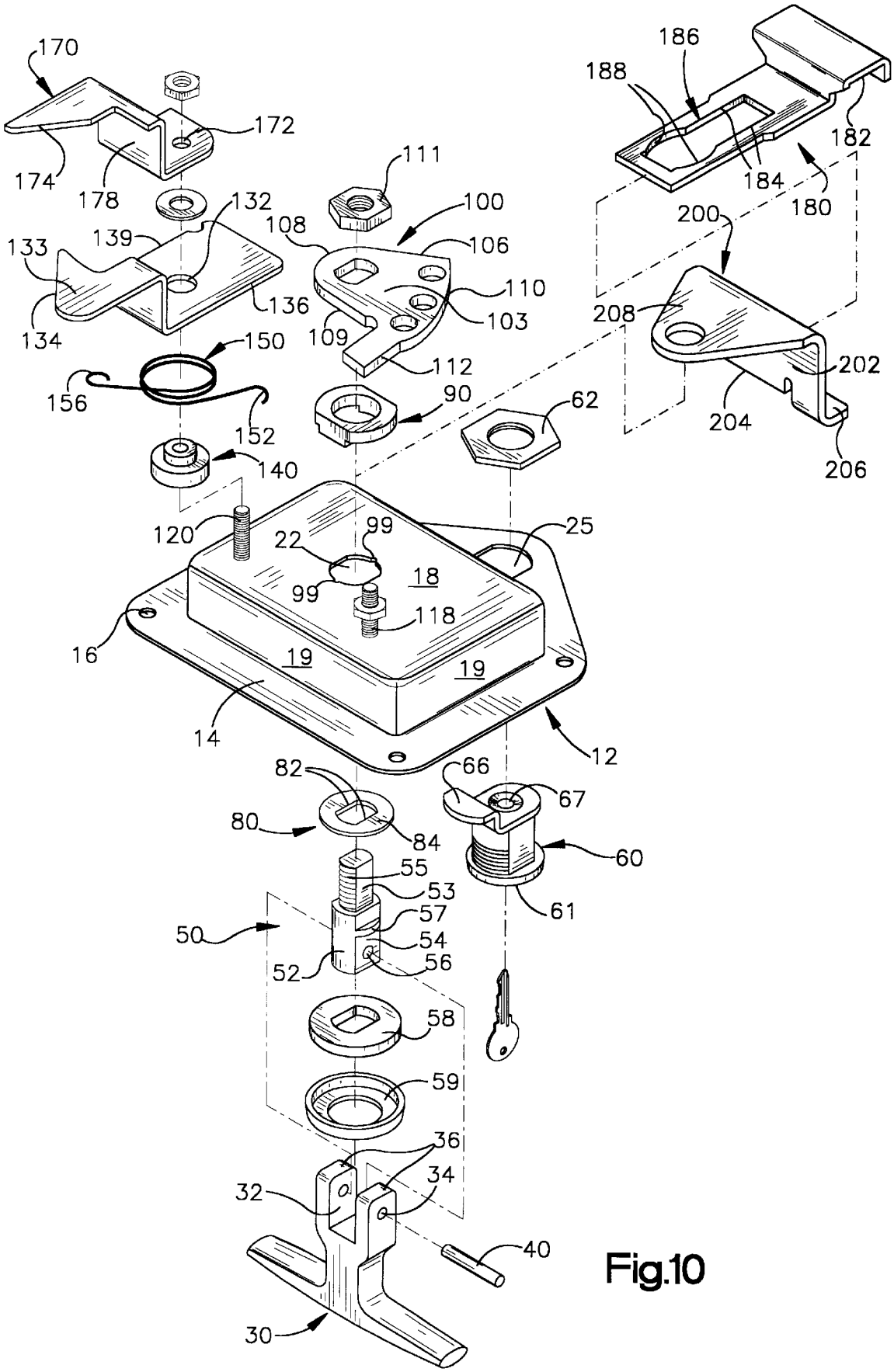
FIG. 10 is an exploded view of the latch assembly of the present invention as shown in FIG. 9.
Figure 12:
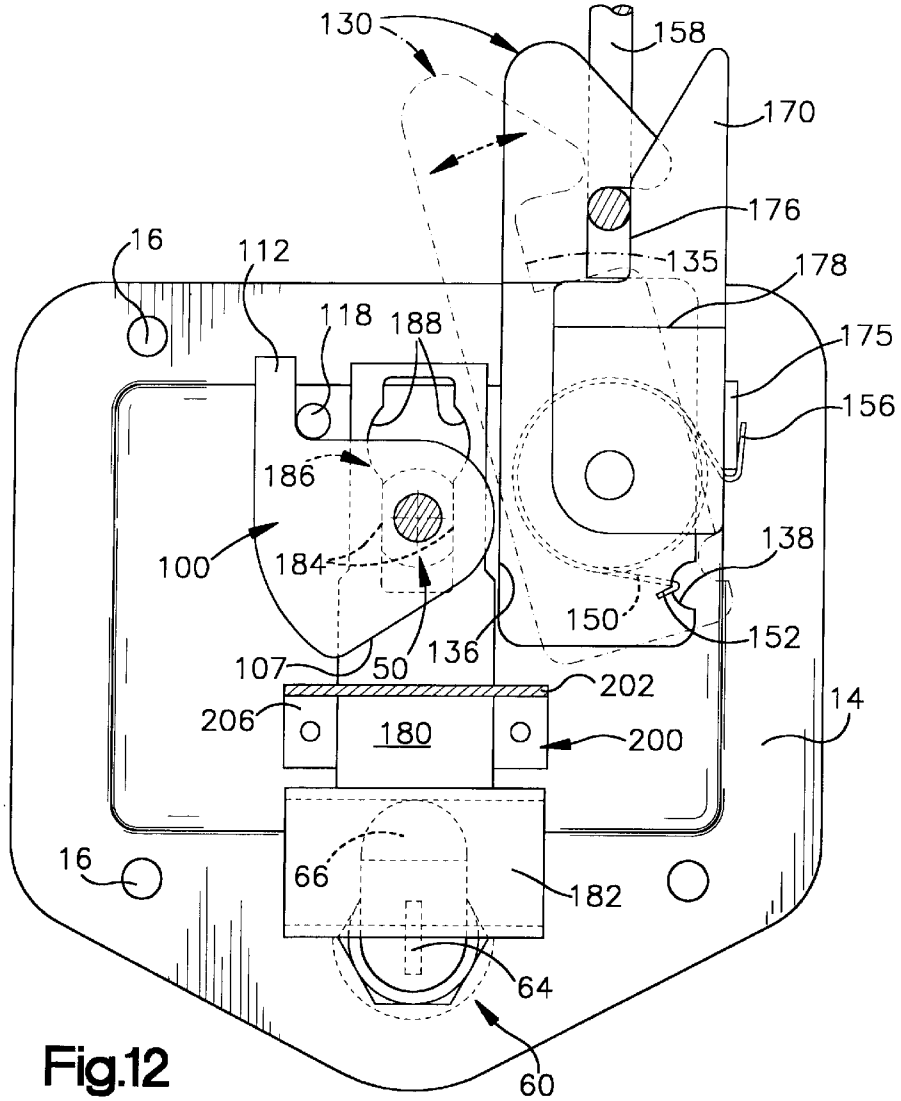
FIG. 12 is a rear view of the latch assembly in a latched and locked position of the present invention as shown in FIG. 9.

As shown in FIGS. 11 and 12, a vertical face 202 of slide support 200 includes an opening 204 through which the lock slide 180 passes. The slide support 200 guides the lock slide 180 in a fixed linear path upon actuation by the lock arm 66. The attachment of support struts 206 such as by welds at points laterally adjacent opposed side edges of lock slide 180 provide structural resistance to torquing of the lock slide 180 induced by rotation of the shank head inner flats 54 against straight edges 184 when the lock slide 180 is in the locked position. The vertical face 202 of the support slide 200 contacts the arc-shaped edge 110 of the cam 100 thus acting as a cam stop when the cam 100 is rotated into the engagement position. The slide support 200 may optionally include the extended section 208 shown only in FIG. 10.

As further shown in FIGS. 9, 10, 12, and 13 a second end 156 of the torsion spring 150 rests against the edge of the bushing 90 between the cam shank 50 and the latch shank 120. Alternatively, end 156 may be held by the latch guide 170. In the second embodiment the optional latch guide 170 has an indexing arm 175 shown in FIGS. 12 and 13, which extends perpendicularly from the latch guide 170 towards the mounting pan 12 contacting the side wall 19 of the pan 12. The indexing arm 175 keeps the latch guide 170 from rotating about the latch shank 50. In addition, when the torsion spring 150 rotates the latch 130 into the latched position from the release position, an exterior edge of the latch lower leg 136 contacts the indexing arm 175 while the interior edge of the latch lower leg 136 contacts the rounded corner 108 of the cam 100 acting in conjunction as a chock to keep the latch 130 from overrotating. The indexing arm 175 also has a cutout which allows the latch to fully rotate into the release position.

When the cam 100 rotates the latch 130 into the release position, the contact edge 106 of the cam 100 acts as a latch stop preventing further rotation of the latch. In addition, when the cam 100 is in the home position, the rounded edge 108 of the cam 100 also acts as a latch stop when the latch 130 is rotated into the release position such as by contact with a striker 158. The edge of the cutout 178 of the latch guide 170 also contacts the exterior edge 139 of the latch lower leg 136 thereby acting as a backup latch stop when the latch 130 is in the release position.

Figure 13:
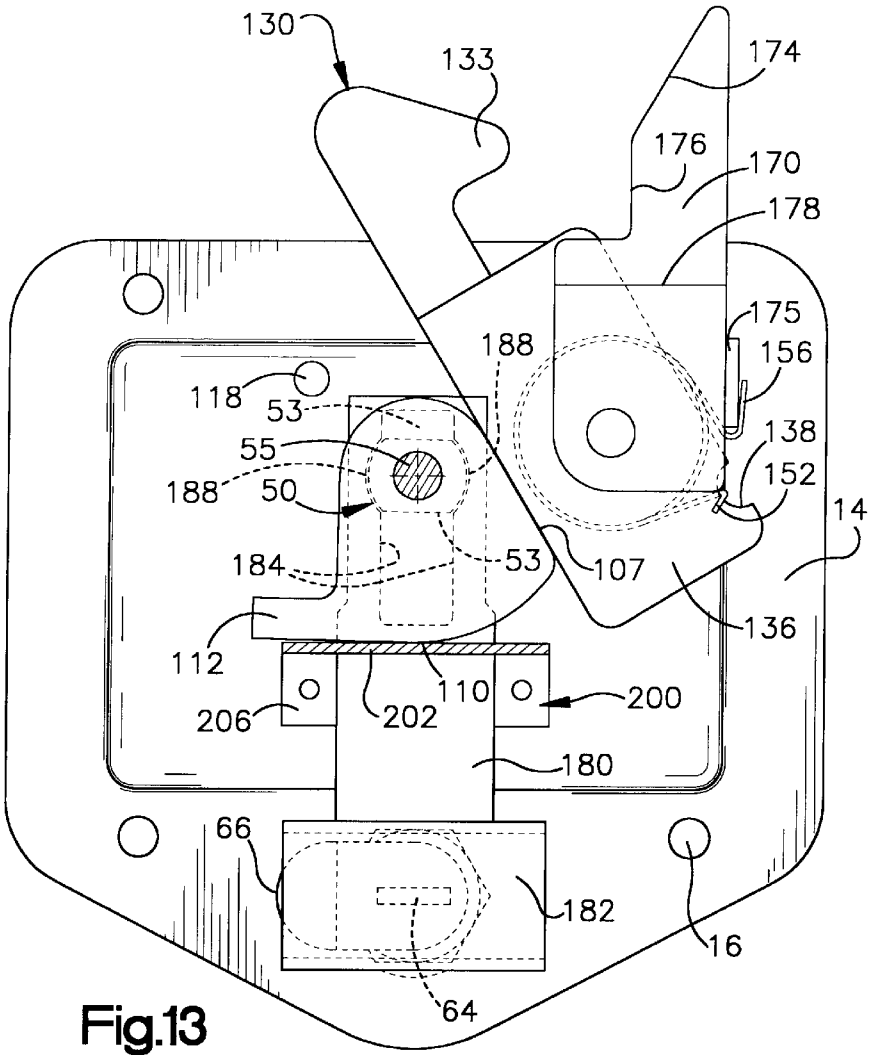
FIG. 13 is a rear view of the latch assembly in a release position of the present invention as shown in FIG. 9.

The operation of the second embodiment can now be described. The handle pin 40 allows pivotal movement of the T handle 30 within the pan draw 18 between a closed/recessed position as shown in bold lines in FIG. 4 and a release/open position as shown in FIG. 5. In operation, , the lock arm 66 is rotated into an unlocked position as shown in FIGS. 13 (in phantom) by turning a key (not shown) thereby sliding the lock slide 180 rounded cutout 188 into alignment with the cam shank 50, allowing the cam shank to rotate. As the T handle 30 is rotated while in the release/open position, the cam shank 50 correspondingly rotates causing rotation of the cam 100. As the cam 100 is rotated, the contact edge of the cam contacts the latch lower leg 136, thereby rotating the latch 130 about latch shank 120 towards the lock assembly such that the striker is released from the displaced striker receiving cavity 135. Thus actuation of the T handle 30 results in rotation of the latch 130 from a latched position to a released position to thereby disengage the hooked end 133 of the latch from the striker. The door/closure is thereby unsecured and may be opened.

Once the handle is rotated to its closed/recessed position, the spring force acts upon the latch 130 rotating it towards the latch guide 170 until the lower leg 136 of the latch contacts the latch guide 170 indexing arm 175 thereby maintaining the latch in the vertical latched position.

Although the invention has been disclosed and described with respect to certain preferred embodiments, certain variations and modifications may occur to those skilled in the art upon reading this specification. Any such variations and modifications are within the purview of the invention notwithstanding the defining limitations of the accompanying claims and equivalents thereof.

What is claimed is:

1. A rotationally actuated latch comprising:

a mounting pan having an exterior side and an interior side;

a rotatable cam shank intersecting the mounting pan;

a handle attached to an end of the cam shank on the exterior side of the pan;

a latch rotationally mounted on a latch shank on the interior side of the mounting pan;

a cam attached to an end of the cam shank on the interior side of the pan; and said cam having a contact edge positionable to contact and rotate said latch upon rotation of said cam shank, wherein said handle is a T handle pivotally mounted upon said cam shank whereby the handle can be folded relative to the mounting pan.

2. A rotationally actuated latch comprising:

a mounting pan having an exterior side and an interior side;

a rotatable cam shank intersecting the mounting pan;

a handle attached to an end of the cam shank on the exterior side of the pan; a latch rotationally mounted on a latch shank on the interior side of the mounting pan;

a cam attached to an end of the cam shank on the interior side of the pan; and said cam having a contact edge positionable to contact and rotate said latch upon rotation of said cam shank, wherein a lock cylinder is mounted in a recessed draw of the mounting pan, and wherein said handle is positionable over said lock cylinder.

3. A rotary actuated latch assembly comprising:

a mounting pan having an interior side and a recessed draw;

a cam shank and a latch shank each rotationally mounted through said draw;

a latch rotationally mounted on said latch shank on the interior side of the mounting pan;

a lock assembly mounted in the recessed draw of the mounting pan;

a handle pivotally and rotationally mounted upon an end of the cam shank on the exterior side of the pan;

said handle having an interior side with a lock cover affixed thereto whereby when said handle is folded down into the recessed draw of the pan the lock cover covers the lock; and a cam attached to an end of the cam shank on the interior side of the pan positionable to contact said latch.

4. The latch assembly of claim 3 wherein said latch assembly further comprises a spring mounted upon said latch shank between said latch and said mounting pan for biasing the latch into the latched position.

5. The latch assembly of claim 3 wherein a latch guide having a tapered vertical end is mounted on the latch shank over the latch.

6. The latch assembly of claim 3 wherein said cam further comprises a rounded corner, a mounting hole, a straight edge, a major flat surface and an arc shaped edge opposite the rounded corner, and an arm which extends from an intersection of the arc shaped edge and the straight edge.

7. The latch assembly of claim 3 wherein a lock stop is mounted upon said cam shank between said pan and said cam; said lock stop is positioned for engagement with a lock arm of said lock assembly whereby said lock arm contacts said lock stop and prevents rotation of said cam.

8. The latch assembly of claim 7 wherein said lock assembly is mounted in the recessed draw of said mounting pan.

9. The latch assembly of claim 3 wherein a sealing gasket is attached to an interior portion of the lock cover.

10. The latch assembly of claim 3 further comprising a mounting plate on said interior side of said mounting pan.

11. The latch assembly of claim 3 wherein said latch assembly further comprises a shoulder spacer mounted between said latch and said mounting pan; and a torsion spring disposed about said shoulder spacer with a first end mounted upon said latch and a second end fixed to said mounting pan.

* * * * *